US010794640B2

(12) United States Patent
Kondo et al.

(10) Patent No.: US 10,794,640 B2
(45) Date of Patent: Oct. 6, 2020

(54) HEAT EXCHANGER AND WATER HEATER INCLUDING SAME

(71) Applicant: NORITZ CORPORATION, Hyogo (JP)

(72) Inventors: Masaki Kondo, Kobe (JP); Takeshi Ohigashi, Kobe (JP)

(73) Assignee: NORITZ CORPORATION, Hyogo (JP)

( * ) Notice: Subject to any disclaimer, the term of this patent is extended or adjusted under 35 U.S.C. 154(b) by 31 days.

(21) Appl. No.: 16/418,494

(22) Filed: May 21, 2019

(65) Prior Publication Data

US 2020/0033071 A1 Jan. 30, 2020

(30) Foreign Application Priority Data

Jul. 27, 2018 (JP) ..... 2018-140962

(51) Int. Cl.
*F28F 9/013* (2006.01)
*F28D 1/047* (2006.01)
*F28F 9/02* (2006.01)

(52) U.S. Cl.
CPC ..... *F28F 9/0131* (2013.01); *F28D 1/0472* (2013.01); *F28F 2009/0292* (2013.01)

(58) Field of Classification Search
CPC ..... F28F 9/0131
See application file for complete search history.

(56) References Cited

U.S. PATENT DOCUMENTS 3,080,916 A * 3/1963 Collins ..... F28D 1/0477 165/151
3,750,418 A * 8/1973 Maudlin ..... F25B 39/02 62/290
4,449,581 A * 5/1984 Blystone ..... F28F 1/32 165/151
4,738,225 A * 4/1988 Juang ..... F28F 1/325 122/235.14

(Continued)

FOREIGN PATENT DOCUMENTS

JP 06194084 A * 7/1994
JP 08042915 A * 2/1996

(Continued)

*Primary Examiner* — Nathaniel Herzfeld
(74) *Attorney, Agent, or Firm* — Studebaker & Brackett PC

(57) ABSTRACT

A heat exchanger includes a heat transfer tube in which a plurality of tube body portions are arranged in a two-tier staggered pattern in a flow direction of heating gas, and a fin, wherein a plurality of cut-out recessed portions are provided in the fin by cutting out sites between first and second upstream side tube body portions, and each cut-out recessed portion extends toward a downstream side in the flow direction of the heating gas beyond the site between the first and second upstream side tube body portions so as to cross straight lines linking a center of a first downstream side tube body portion, which is positioned between the first and second upstream side tube body portions in the width direction, and respective centers of the first and second upstream side tube body portions. Thus, the temperature distribution of the fin is made even, thereby suppressing the generation of thermal stress, and as a result, distortion of the heat transfer tube is suppressed.

7 Claims, 3 Drawing Sheets

(56) References Cited

U.S. PATENT DOCUMENTS

| | | | | | |
|---|---|---|---|---|---|
| 5,667,006 | A * | 9/1997 | Kang | F28F 1/325 | 165/151 |
| 6,321,833 | B1 * | 11/2001 | O'Leary | F28D 7/06 | 165/151 |
| 2014/0190425 | A1 * | 7/2014 | Oohigashi | F28F 1/325 | 122/18.4 |
| 2016/0273850 | A1 * | 9/2016 | Okamoto | F28F 21/083 | |
| 2017/0205113 | A1 * | 7/2017 | Oohigashi | F28D 1/053 | |
| 2018/0306529 | A1 * | 10/2018 | Kasamatsu | F28D 1/0477 | |

FOREIGN PATENT DOCUMENTS

| | | | | |
|---|---|---|---|---|
| JP | 2000205657 | A * | 7/2000 | |
| JP | 2001241688 | A * | 9/2001 | F28F 1/32 |
| JP | 2003014308 | A * | 1/2003 | |
| JP | 6314106 | B2 | 4/2018 | |

* cited by examiner

HEAT EXCHANGER AND WATER HEATER INCLUDING SAME

BACKGROUND OF THE INVENTION

Field of the Invention

The present invention relates to a heat exchanger employing a so-called fin tube type heat transfer tube, and a water heater such as a hot water supply device that includes the heat exchanger.

Description of the Related Art

Japanese Patent No. 6314106 describes a specific example of a heat exchanger forming a water heater.

The heat exchanger described in this document is capable of generating hot water by recovering heat from combustion gas (heating gas) generated by a burner using a heat transfer tube equipped with a fin in order to heat water flowing through the heat transfer tube.

In this type of heat exchanger, the fin exhibits a heat absorption action, which is useful in improving the thermal efficiency. However, the fin is penetrated by and bonded to the heat transfer tube, and therefore great thermal stress is generated in the fin when the combustion gas acts thereon. When this thermal stress is generated, the force thereof also acts on the heat transfer tube, thereby distorting the heat transfer tube. In order to improve the durability and reliability of the heat exchanger, it is desirable that this phenomenon be suppressed.

Meanwhile, as indicated in Japanese Patent No. 6314106, a component in which a plurality of straight tube body portions are arranged in an up-down two-tier staggered pattern is widely used as a heat exchanger. In this type of heat exchanger, upstream side parts (upper side parts) of the fin in the flow direction of the combustion gas, and especially regions between tube body portions (upper tier tube body portions) positioned on the upstream side in the flow direction of the combustion gas, reach an extremely high temperature, whereas downstream side parts (lower side parts) in the flow direction of the combustion gas do not reach a very high temperature. This temperature difference causes thermal stress to be generated in the fin, and as the temperature difference increases, the thermal stress generated in the fin also increases, leading to an increase in the likelihood of large distortion occurring in the heat transfer tube.

In Japanese Patent No. 6314106, therefore, cut-out recessed portions cut out from the upstream side parts (the upper side parts) of the fin in the flow direction of the combustion gas, i.e. the regions between the tube body portions (the upper tier tube body portions) positioned on the upstream side in the flow direction of the combustion gas, are provided as means for suppressing this problem. With this configuration, the regions that are inherently most likely to reach a high temperature no longer exist, and therefore the overall temperature distribution of the fin when the fin is heated can be made even, enabling a reduction in thermal stress.

As described below, however, there remains room for improvement in the prior art described above.

When the fin is heated by the combustion gas, intermediate regions between tube body portions that are adjacent in a diagonal direction are also likely to reach a high temperature. The cut-out recessed portions described above, however, are not provided in these regions. When the cut-out recessed portions are provided between the tube body portions (the upper tier tube body portions) positioned on the upstream side in the flow direction of the combustion gas, the heat of the combustion gas is likely to spread to the intermediate regions between the tube body portions that are adjacent in the diagonal direction, and therefore these intermediate regions are more likely to reach a high temperature. When these high-temperature regions are formed, it becomes difficult to reduce variation in the overall temperature distribution of the fin, and therefore thermal stress is generated in the fin. As a result, large distortion may occur in the heat transfer tube due to this thermal stress. The occurrence of large distortion in the heat transfer tube is undesirable.

CITATION LIST

Patent Literature 1: Japanese Patent No. 6314106

SUMMARY OF THE INVENTION

An object of the present invention is to provide a heat exchanger that is capable of appropriately preventing or suppressing the problem described above, and a water heater including the heat exchanger.

To solve the problem described above, the present invention employs the following technical means.

A heat exchanger provided by a first aspect of the present invention includes a case into which heating gas flows, a heat transfer tube that is disposed inside the case and includes a plurality of tube body portions arranged at intervals in a width direction intersecting a flow direction of the heating gas, the plurality of tube body portions being arranged in a two-tier staggered pattern in the flow direction of the heating gas so as to be divided into a plurality of upstream side tube body portions and a plurality of downstream side tube body portions, and a fin that is penetrated by and bonded to the plurality of tube body portions. A plurality of cut-out recessed portions are provided in upstream side parts of the fin in the flow direction of the heating gas by cutting out sites between adjacent first and second upstream side tube body portions among the plurality of upstream side tube body portions. Each cut-out recessed portion extends toward a downstream side in the flow direction of the heating gas beyond the site between the first and second upstream side tube body portions so as to cross straight lines linking a center of a first downstream side tube body portion of the plurality of downstream side tube body portions, the first downstream side tube body portion being positioned between the first and second upstream side tube body portions in the width direction, and respective centers of the first and second upstream side tube body portions.

Preferably, a downstream side part of each cut-out recessed portion in the flow direction of the heating gas is constituted by two extension portions that bifurcate in the width direction, and the two extension portions respectively extend to positions on left and right sides of a part of the first downstream side tube body portion near the upstream side in the flow direction of the heating gas.

Preferably, at least one slit is provided in the fin between the plurality of downstream side tube body portions, a length of the slit in the flow direction of the heating gas being equal to or greater than an outer diameter of each of the plurality of downstream side tube body portions.

Preferably, the heat exchanger according to the present invention further includes a plurality of cut and raised pieces provided in the fin and erected on a front side or a rear side of the fin so as to extend in the width direction, wherein the cut and raised pieces are respectively positioned between the plurality of downstream side tube body portions on the downstream side thereof in the flow direction of the heating gas, and a width thereof is greater than an inside width between the plurality of downstream side tube body portions.

Preferably, the heat exchanger according to the present invention further includes contact portions provided on parts of respective end portions of the fin on the upstream side in the flow direction of the heating gas so as to be capable of contacting respective side wall portions of the case, wherein cut-out recessed portions positioned on respective width direction ends, among the plurality of cut-out recessed portions, extend beyond the contact portions toward the downstream side in the flow direction of the heating gas.

A water heater provided by a second aspect of the present invention includes the heat exchanger provided by the first aspect of the present invention.

Preferably, the water heater according to the present invention further includes a burner that supplies combustion gas into the case of the heat exchanger, wherein the combustion gas serves as the heating gas.

Other features and advantages of the present invention will become more apparent from the embodiment of the invention to be described below with reference to the attached figures.

DETAILED DESCRIPTION OF THE PREFERRED EMBODIMENTS

A preferred embodiment of the present invention will be described specifically below with reference to the figures.

Figure 1A:
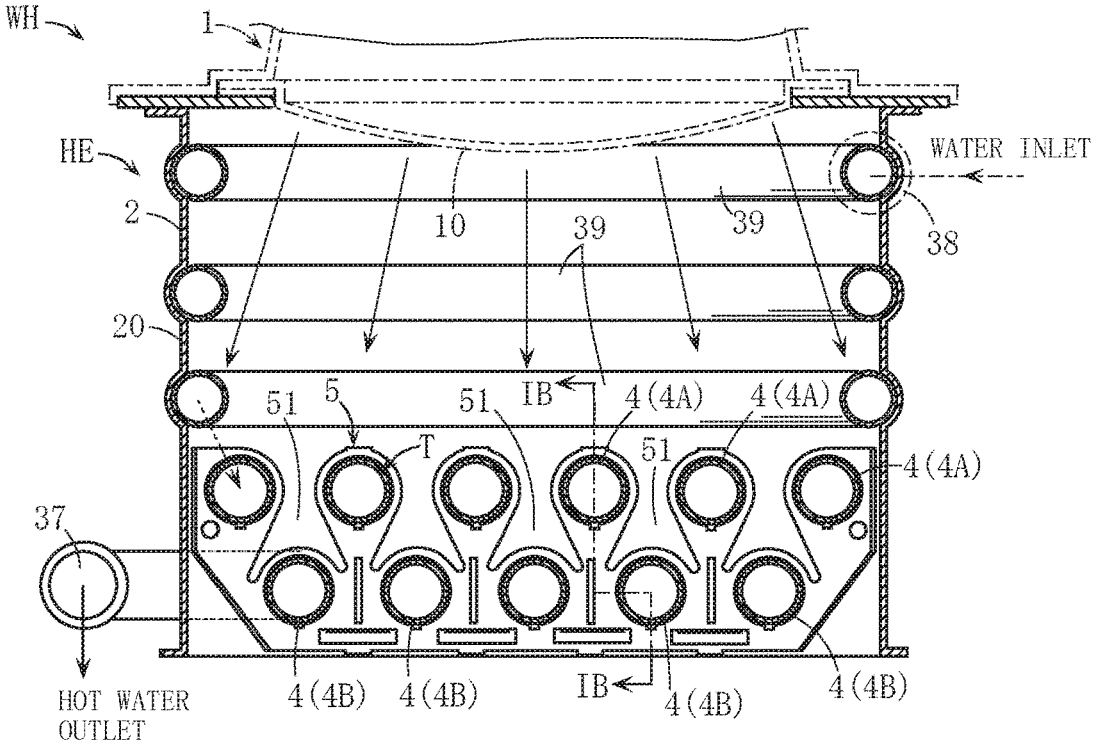
FIG. 1A is a sectional view showing main parts of an example of a water heater according to the present invention.
Figure 1B:
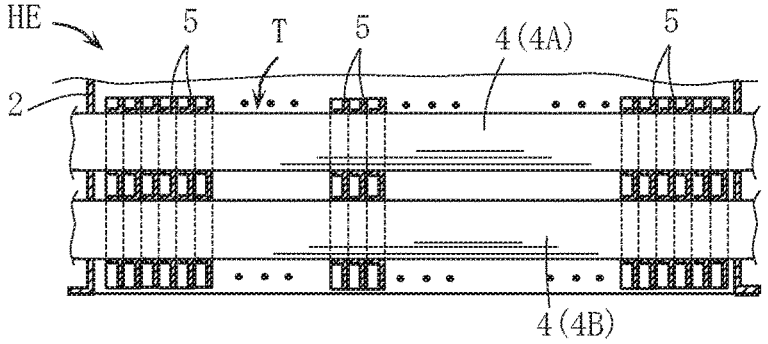
FIG. 1B is an IB-IB sectional view of FIG. 1A.

A water heater WH shown in FIGS. 1A and 1B includes a burner 1, a part of which is indicated by virtual lines, and a heat exchanger HE. Although not shown in the figures, a separate heat exchanger (a secondary heat exchanger) to the heat exchanger HE, a member for discharging combustion gas (exhaust gas) to the outside following heat recovery, or the like, for example, is provided on a lower side of the heat exchanger HE.

The burner 1 employs a so-called reverse combustion system in which combustion gas generated thereby is forced to advance downward. In the burner 1, fuel gas is intermixed with combustion air ejected from a fan (not shown), and this gas-air mixture is injected into a case 2 of the heat exchanger HE through a gas-permeable gas-air mixture injecting member 10 provided so as to face downward from an upper opening portion of the case 2. The gas-air mixture is ignited, whereupon combustion gas is supplied into the case 2 as heating gas.

The heat exchanger HE includes, in addition to the case 2, a heat transfer tube T, a plurality of fins 5, and a plurality of trunk pipes 39, all of which are formed from stainless steel, for example. The trunk pipes 39 are provided along inner surfaces of respective side wall portions 20 of the case 2 and serve to recover heat from the combustion gas and to cool the side wall portions 20. Water supplied to water inlets 38 of the trunk pipes 39 passes through the trunk pipes 39, flows into and passes through the heat transfer tube T, and then reaches a hot water outlet 37.

The heat transfer tube T is formed by connecting, via bend tubes (not shown), a plurality of straight tube body portions 4 that are arranged side by side in series across the case 2 in up-down and horizontal directions. The plurality of tube body portions 4 are arranged in an up-down two-tier staggered pattern. In this embodiment, a flow direction of the combustion gas (the flow direction of the heating gas) is downward, and therefore the tube body portions 4 on the upper tier side correspond to upstream side tube body portions 4 (4A) while the tube body portions 4 on the lower tier side correspond to downstream side tube body portions 4 (4B).

The plurality of fins 5 are penetrated by the plurality of tube body portions 4 and brazed to the tube body portions 4, and are arranged in a plurality at appropriate intervals in an axial direction of the tube body portions 4.

Figure 2:
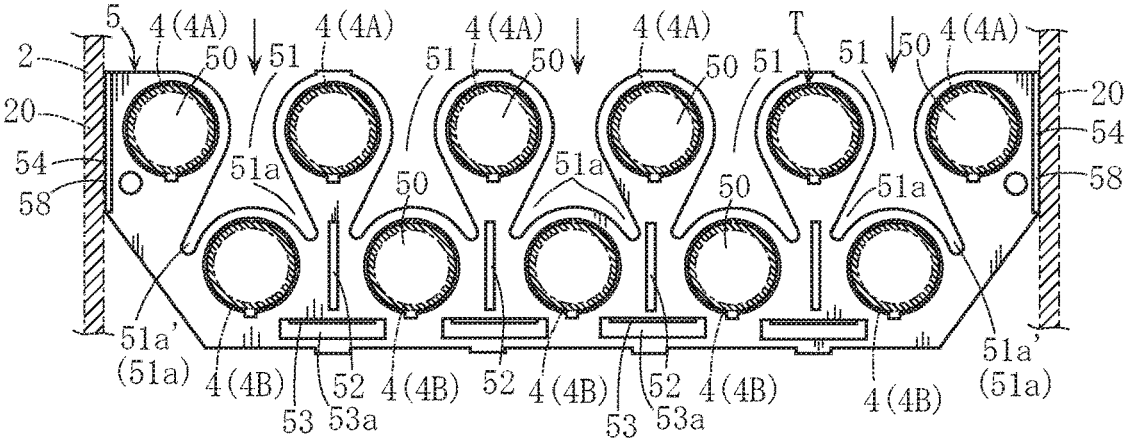
FIG. 2 is a front view of a fin used in the water heater shown in FIG. 1A.
Figure 3A:
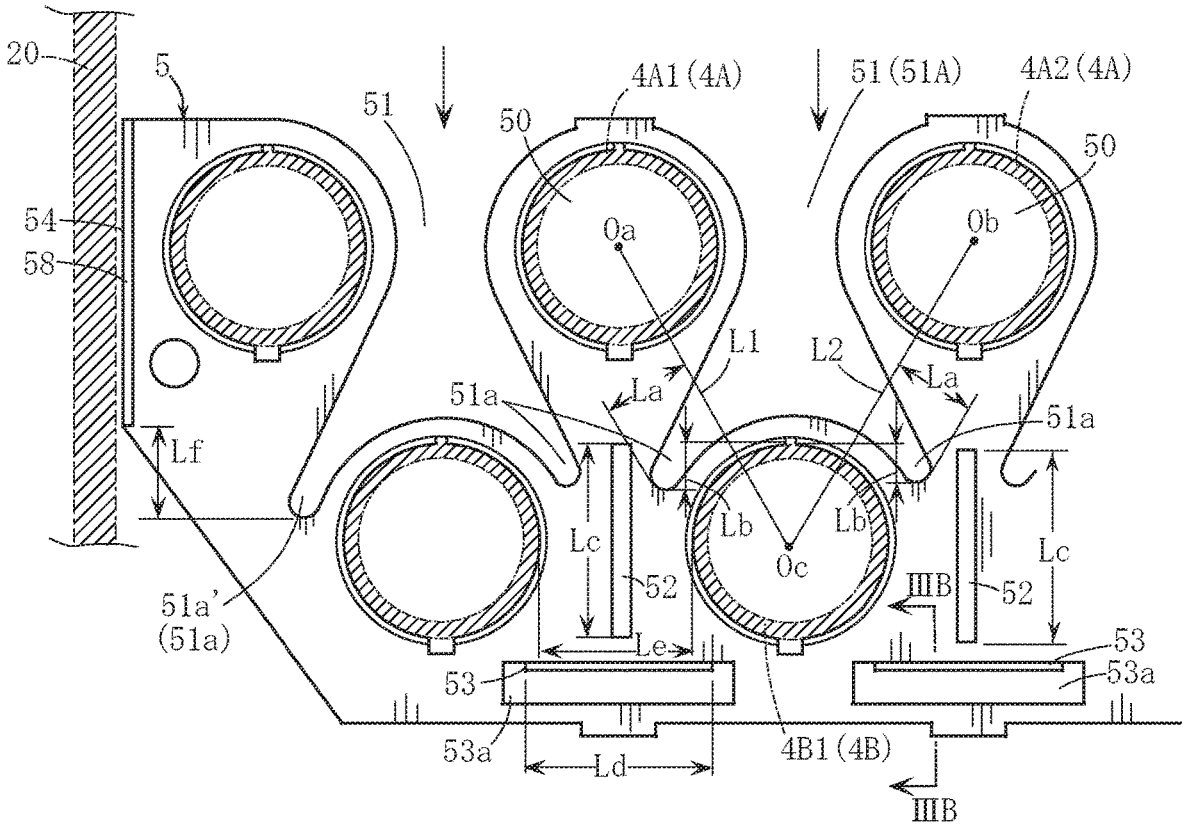
FIG. 3A is an enlarged front view of the main parts of FIG. 2.
Figure 3B:
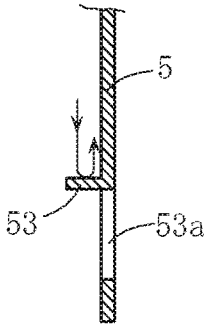
FIG. 3B is an IIIB-IIIB sectional view of FIG. 3A.
Figure 4:
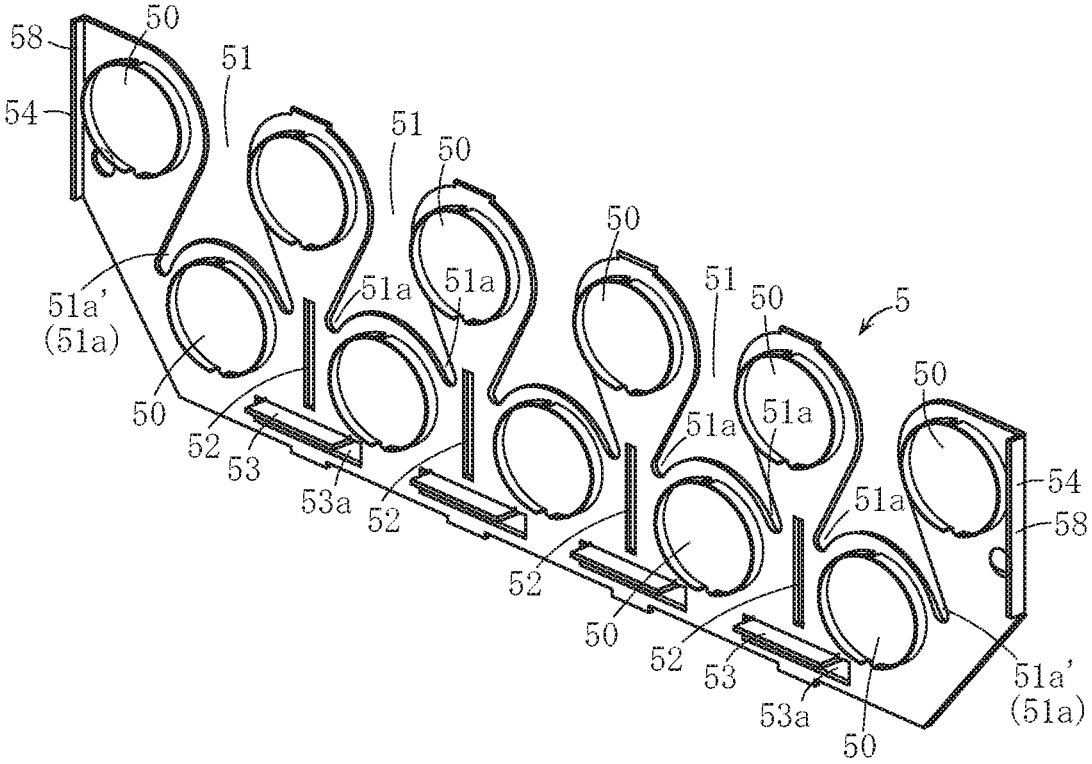
FIG. 4 is a perspective view of the fin used in the water heater shown in FIG. 1A.

As is evident from FIGS. 2 to 4, each fin 5 includes a plurality of through holes 50 that are penetrated by the respective tube body portions 4, a plurality of cut-out recessed portions 51, a plurality of slits 52, a plurality of cut and raised pieces 53, and a left-right pair of contact portions 54.

In FIG. 3A, the cut-out recessed portion 51 (51A) is a site cut out between adjacent first and second upstream side tube body portions 4A (4A1, 4A2), among the plurality of upstream side tube body portions 4A, and a lower region thereof is constituted by two extension portions 51*a* that bifurcate in a width direction. The two extension portions 51*a* extend downward past straight lines L1, L2 (extend beyond the straight lines L1, L2 by a dimension La) linking respective centers Oa, Ob of the first and second upstream side tube body portions 4A1, 4A2 to a center Oc of a first downstream side tube body portion 4B1 positioned therebetween in the width direction. Further, the two extension portions 51*a* extend downward beyond an upper end portion of the first downstream side tube body portion 4B1 by an appropriate dimension Lb so as to be positioned on the left and right sides of a region near an upper portion of the first downstream side tube body portion 4B1.

In the above description, a single cut-out recessed portion 51 (51A) was extracted as a representative from the plurality of cut-out recessed portions 51, and the plurality of tube body portions 4 related thereto were set as the first and second upstream side tube body portions 4A1, 4A2 and the first downstream side tube body portion 4B1. The plurality of cut-out recessed portions 51 have similar configurations, and needless to mention, the first and second upstream side tube body portions 4A1, 4A2 and the first downstream side tube body portion 4B1 are not limited to those shown in FIG. 3A.

Each slit 52 is provided in the fin 5 between the plurality of downstream side tube body portions 4B so as to extend in the up-down direction. An up-down length Lc of each slit 52 equals or exceeds the outer diameter of each downstream side tube body portion 4B.

Each cut and raised piece 53 is formed by forming a cut in the fin 5 and then cutting and raising a part of the fin 5, and the cut and raised pieces 53 are erected on a front side or a rear side of the fin 5 so as to extend in the width direction. A hole portion 53*a* is formed on the lower side of each cut and raised piece 53. Each cut and raised piece 53 is provided on the lower side of a region between adjacent downstream side tube body portions 4B, and a length Ld thereof is greater than an inside width Le between the downstream side tube body portions 4B.

The contact portions 54 are parts located on upper portions of respective end portions of the fin 5 so as to be capable of contacting the side wall portions 20 of the case 2. A bent piece 58 bent toward the front or the rear of the fin 5 is preferably formed on each contact portion 54. Extension portions 51*a*' (51*a*) of the cut-out recessed portions 51 positioned respectively on the width direction ends, among the plurality of cut-out recessed portions 51, extend downward beyond the contact portions 54 by an appropriate dimension Lf.

Next, actions of the above water heater WH will be described.

When the fin 5 receives combustion gas, regions of the fin 5 between the first and second upstream side tube body portions 4A1, 4A2 and between the first downstream side tube body portion 4B1 and the first and second upstream side tube body portions 4A1, 4A2 in FIG. 3A are inherently more likely to reach an extremely high temperature than other regions. However, the cut-out recessed portions 51 are formed in series in the locations that are likely to reach a high temperature. It is therefore possible to prevent the formation of regions of the fin 5 that reach a much higher temperature than the other regions and to ensure that the temperature distribution of the fin 5 is even.

A part of the fin 5 on an upper side of the first downstream side tube body portion 4B1 is also a region that is inherently more likely to reach a high temperature than the other regions of the fin 5. However, the bifurcated extension portions 51*a* of the cut-out recessed portion 51 are formed to extend into this part, thereby eliminating the part that reaches a high temperature. Hence, an even more favorable effect is obtained in terms of making the overall temperature distribution of the fin 5 more even and reducing thermal stress. When the thermal stress of the fin 5 is reduced, force acting on the heat transfer tube T from the fin 5 decreases, and as a result, distortion of the heat transfer tube T can be suppressed, enabling an improvement in the durability and so on of the heat transfer tube T. Moreover, the cut-out recessed portion 51 is formed to be comparatively large, leading to reductions in the width of the fin 5 around the upstream side tube body portions 4A and around the upper portions of the downstream side tube body portions 4B, and as a result, the force acting on the tube body portions 4A, 4B when these parts increase in temperature also decreases. For this reason also, distortion of the heat transfer tube T can be reduced.

When thermal stress is generated in the fin 5 between the downstream side tube body portions 4B, force inherently acts directly on the plurality of downstream side tube body portions 4B from the fin 5. In this embodiment, however, the slits 52 having the up-down length Lc that equals or exceeds the outer diameter of the downstream side tube body portions 4B are provided in these parts, and therefore these parts act as buffer portions for weakening the force that acts on the downstream side tube body portions 4B from the fin 5. As a result, an even more favorable effect is obtained in terms of preventing distortion of the downstream side tube body portions 4B. Moreover, the parts of the fin 5 between the downstream side tube body portions 4B are likely to reach slightly higher temperatures than the other parts, but by providing the slits 52, this temperature increase is suppressed. As a result, evening out the temperature distribution of the fin 5 is achieved more appropriately.

The cut and raised pieces 53 serve to improve the thermal efficiency by performing an action for obstructing the flow of the combustion gas so as to increase the degree of contact between the combustion gas and the downstream side tube body portions 4B, an action for increasing the flow speed of the combustion gas passing between the cut and raised pieces 53 and the downstream side tube body portions 4B, and so on. Further, the cut and raised pieces 53 act to raise the temperature of a lower edge side of the fin 5 by increasing the amount of heat absorbed in this part. In so doing, a temperature difference between the lower edge side and an upper edge side of the fin 5 is reduced, thereby further promoting evening out of the temperature distribution of the fin 5 and a reduction in thermal stress.

When the temperature of the fin 5 increases, the contact portions 54 of the fin 5 are pressed against the side wall portions 20 of the case 2 by thermal expansion. However, the extension portions 51*a*' of the cut-out recessed portions 51 positioned near the contact portions 54 of the fin 5 extend downward beyond the contact portions 54, and therefore the cut-out recessed portions 51 including the extension portions 51*a*' exhibit an action for weakening the contact pressure between the contact portions 54 and the side wall portions 20 (increasing flexibility near the respective end portions of the fin 5). As a result, stress generated in the fin 5 can be further reduced. Moreover, stress generated in the side wall portions 20 of the case 2 can also be reduced.

The present invention is not limited to the content of the embodiment described above, and the specific configurations of the respective parts of the heat exchanger and the water heater including the heat exchanger according to the present invention may be freely subjected to various design modifications within the intended scope of the present invention.

In the above embodiment, a reverse combustion system in which the burner is disposed on the upper side of the heat exchanger is employed, but the present invention is not limited thereto, and a normal combustion system in which the burner is disposed on the lower side of the heat exchanger may be employed instead. In this case, the flow direction of the combustion gas (the heating gas) is upward.

The fin is not limited to be formed from stainless steel and may be formed from another material.

In the heat transfer tube, as long as the plurality of tube body portions penetrating the fin are arranged in a two-tier staggered pattern in the flow direction of the heating gas, the specific number, arrangement pitch, and so on thereof are not limited.

The heating gas is not limited to combustion gas, and high-temperature exhaust gas generated in a cogeneration system or the like, for example, may be used instead.

The water heater according to the present invention has a function for generating hot water by heating water, and in addition to a general water heater, the water heater includes a bath hot water supply device, an air-heating water heater, a snow-melting water heater, and so on, for example.

The invention claimed is:

1. A heat exchanger, comprising:

a case into which heating gas flows;

a heat transfer tube that is disposed inside the case and includes a plurality of tube body portions arranged at intervals in a width direction intersecting a flow direction of the heating gas, the plurality of tube body portions being arranged in a two-tier staggered pattern in the flow direction of the heating gas so as to be divided into a plurality of upstream side tube body portions and a plurality of downstream side tube body portions; and a fin that is penetrated by and bonded to the plurality of tube body portions, wherein a plurality of cut-out recessed portions are provided in upstream side parts of the fin in the flow direction of the heating gas by cutting out sites between adjacent first and second upstream side tube body portions among the plurality of upstream side tube body portions, and each cut-out recessed portion extends toward a downstream side in the flow direction of the heating gas beyond the site between the first and second upstream side tube body portions so as to cross straight lines linking a center of a first downstream side tube body portion of the plurality of downstream side tube body portions, the first downstream side tube body portion being positioned between the first and second upstream side tube body portions in the width direction, and respective centers of the first and second upstream side tube body portions.

2. The heat exchanger according to claim 1, wherein a downstream side part of each cut-out recessed portion in the flow direction of the heating gas is constituted by two extension portions that bifurcate in the width direction, and the two extension portions respectively extend to positions on left and right sides of a part of the first downstream side tube body portion near the upstream side in the flow direction of the heating gas.

3. The heat exchanger according to claim 1, wherein at least one slit is provided in the fin between the plurality of downstream side tube body portions, a length of the slit in the flow direction of the heating gas being equal to or greater than an outer diameter of each of the plurality of downstream side tube body portions.

4. The heat exchanger according to claim 1, further comprising:

a plurality of cut and raised pieces provided in the fin and erected on a front side or a rear side of the fin so as to extend in the width direction, wherein the cut and raised pieces are respectively positioned between the plurality of downstream side tube body portions on the downstream side thereof in the flow direction of the heating gas, and a width thereof is greater than an inside width between the plurality of downstream side tube body portions.

5. The heat exchanger according to claim 1, further comprising:

contact portions provided on parts of respective end portions of the fin on the upstream side in the flow direction of the heating gas so as to be capable of contacting respective side wall portions of the case, wherein cut-out recessed portions positioned on respective width direction ends, among the plurality of cut-out recessed portions, extend beyond the contact portions toward the downstream side in the flow direction of the heating gas.

6. A water heater, comprising:

the heat exchanger according to claim 1.

7. The water heater according to claim 6, further comprising:

a burner that supplies combustion gas into the case of the heat exchanger, wherein the combustion gas serves as the heating gas.

* * * * *